US006955289B2

(12) United States Patent
Green

(10) Patent No.: US 6,955,289 B2
(45) Date of Patent: Oct. 18, 2005

(54) CONTAINER HAVING AN INTEGRAL LID

(75) Inventor: John Green, Surrey (GB)

(73) Assignee: Lid Lock Cup Co. Ltd., (GB)

( * ) Notice: Subject to any disclaimer, the term of this patent is extended or adjusted under 35 U.S.C. 154(b) by 0 days.

(21) Appl. No.: 10/773,778

(22) Filed: Feb. 6, 2004

(65) Prior Publication Data

US 2005/0173507 A1 Aug. 11, 2005

(51) Int. Cl.[7] ..... B65D 3/20

(52) U.S. Cl. ..... 229/128; 229/125.17; 229/160.2; 229/404

(58) Field of Search ..... 229/5.5, 128, 125.17, 229/160.2, 400, 402, 404, 902

(56) References Cited

U.S. PATENT DOCUMENTS 1,177,145 A * 3/1916 Schmalz ..... 229/125.17
1,745,101 A * 1/1930 Labombarde ..... 229/125.17
3,150,811 A * 9/1964 Amberg ..... 229/5.5
3,933,297 A * 1/1976 Carlsson et al. ..... 229/125.17
4,135,512 A * 1/1979 Godsey ..... 206/217
4,620,665 A * 11/1986 McSherry ..... 229/128
4,850,528 A 7/1989 Hanus
5,358,175 A 10/1994 Cai
5,676,306 A 10/1997 Lankin et al.
5,960,987 A * 10/1999 Solland et al. ..... 229/404
6,164,488 A 12/2000 Solland et al.
6,176,420 B1 * 1/2001 Sarson et al. ..... 229/128
6,758,390 B2 * 7/2004 Sarson et al. ..... 229/128

* cited by examiner

*Primary Examiner*—Gary E. Elkins
(74) *Attorney, Agent, or Firm*—Fulbright & Jaworski L.L.P.

(57) ABSTRACT

A container is the form of a cup which includes an integral lid hingedly connected to the wall of the cup at a position adjacent to the rim. The wall of the cup includes a groove disposed entirely below the rim of the cup with the peripheral edge of the lid captured in the groove when the lid is closed and positioned below the rim thereby accomplishing a seal of the lid to the cup.

8 Claims, 4 Drawing Sheets

CONTAINER HAVING AN INTEGRAL LID

FIELD OF THE INVENTION

The present invention relates to a container and more particularly to a container having an integral lid which is hingedly connected to the container and which when closed provides a seal about the periphery of the lid by seating within a groove formed in the wall of the container.

BACKGROUND OF THE INVENTION

In fast-food restaurants and similar such establishments, beverages at present are normally served in a round container having a conically upwards and outwards sloping side wall and typically such containers are used with loose lids that can be fitted over the upper rim of the container. The lid typically is provided with a weakening in the center or other position of the lid through which a drinking straw can be pushed for consuming the contents of the container without the need to remove the lid.

Such containers have numerous drawbacks in that the use of a lid which caps such a container is not effective in preventing the beverage from leaking from the container during use and particularly if the container were to be upset. Such occurs because the container has a relatively thin wall which is easily deformed when it is upset and the lid will loosen causing the contents of the container to be dispensed even though such is not desired.

To overcome such problems existing in the typical prior art disposable containers, a self-sealing portable container was sought after. Various types of structures have been disclosed such, for example, as that shown in U.S. Pat. No. 5,358,175, which is a container formed of a foldable sheet material which requires assembly, interconnection of flaps and a tongue-slot combination. U.S. Pat. No. 4,850,528 discloses a self-locking, self-closing container using a spring-action pleated top. U.S. Pat. No. 5,676,306 discloses a container having a sealing top formed by a series of crease lines folding inwardly and forming a series of rectangles, each having a diagonal corner portion to form a closure panel. U.S. Pat. No. 4,135,512 discloses a container having an integral flat lid hinged to a cylindrical wall. The lid extends in a downward slope and locks in a closed position between two ridges formed in opposite sides of the wall. The lid contains a plurality of openings therein so that liquid contained in the container can pass through the closed lid along with medication held on top of the lid. The most pertinent prior art known to applicant is that shown in U.S. Pat. Nos. 5,960,987 and 6,164,488. These two patents disclose a container having an integral lid hinged about the wall of the container to selectively close and seal the same on demand. The integral lid is formed by a crease within the wall of the container and the crease defines the bottom end of the lid. The lid's top end is arcuate and extends above the top portion of the cup. The user can then move the lid to a closed position so that it engages a ridge causing the lid to conform to the shape of the top portion of the cup with the lid extending generally upwardly with the lid defining an aperture through which the contents of the container may be dispensed. Although devices of this type do function somewhat effectively, it has been found that the leakage around the lid is such that the utility of the package is somewhat limited and creates undesirable spillage of the contents during attempted use of the container.

There is thus a need for a simple self-sealing container utilizing an integral lid which accomplishes a positive and effective seal when the lid is closed so that leakage from the container is eliminated during normal use thereof.

SUMMARY OF THE INVENTION

A container having an integral lid which container includes a wall interconnecting a rim and a bottom with the rim having a first diameter, a lid having a peripheral edge and being hingedly connected to the wall at a position adjacent to the rim and a groove in the wall disposed entirely below the rim with the peripheral edge of the lid being captured in the groove when the lid is closed and is positioned below the rim accomplishing a seal at the periphery of the lid.

DETAILED DESCRIPTION

Figure 1:
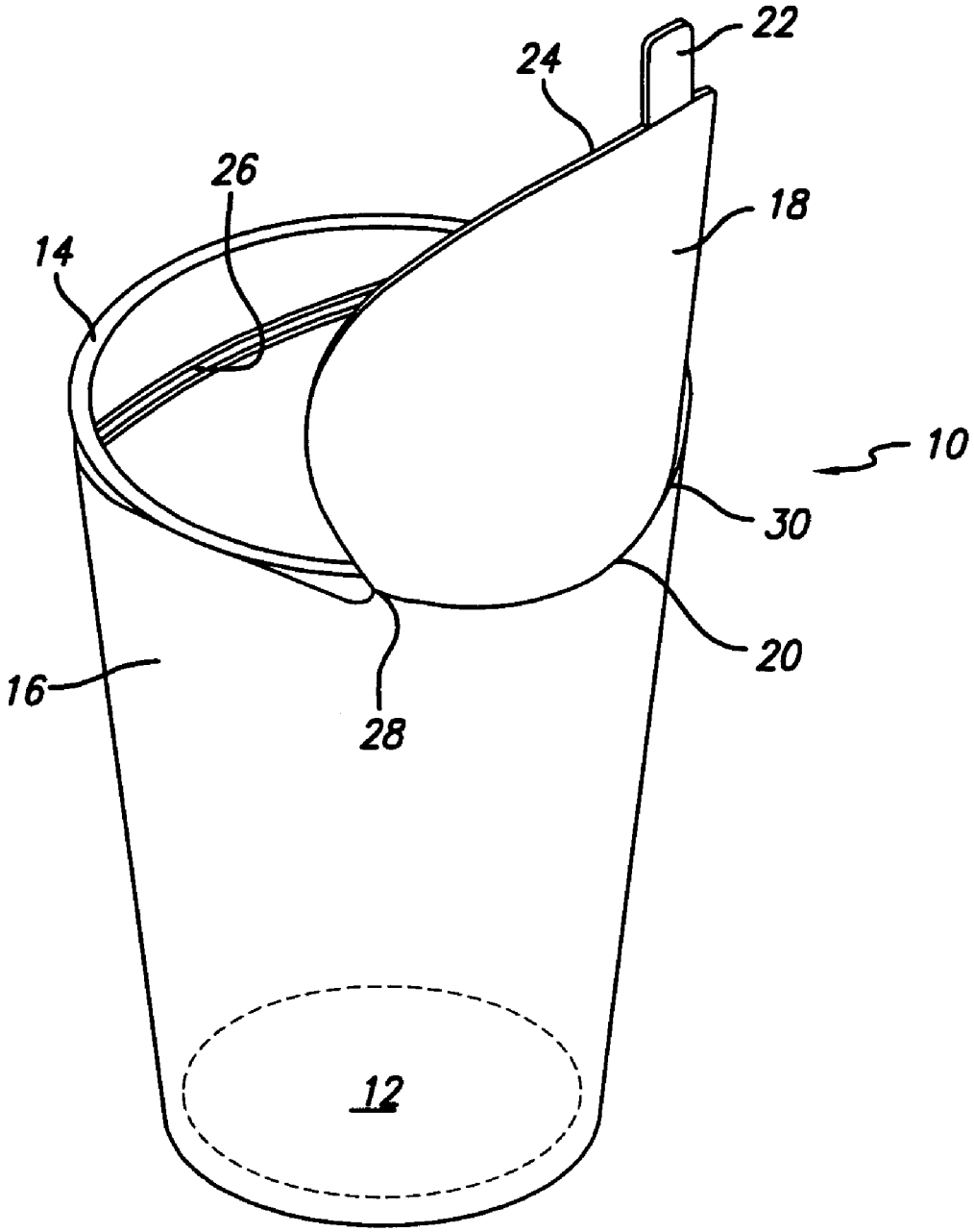
FIG. 1 is a perspective view showing a container having an integral lid constructed in accordance with the principles of the present invention with the lid open.

Referring now more particularly to FIG. 1, there is illustrated in a perspective view a container having an integral lid constructed in accordance with the principles of the present invention. As is therein shown, the container 10 includes a bottom 12 and a rim 14 and a continuous wall 16 interconnecting the bottom 12 and the rim 14. A lid 18 which is integral with the wall 16 extends upwardly from the wall above the rim 14. A score line 20 formed in the material from which the wall 16 and the lid 18 is formed functions as a hinge to permit closure of the lid 18 as will be described more fully hereinafter.

The structure thus far described will typically be formed by die cutting from a blank of material of any type desired which is typically utilized to form disposable containers. For example such material may include a polyurethane foam, food grade polyethylene terephthalate (PET) or a packaging laminate comprising a core layer of materials such as paper, foil, cardboard, chipboard, fluteboard, or the like which is coated on either or both sides thin layers of thermoplastic material, for example, polyethylene and may also include high density polyethylene.

The lid 18 may have a tab 22 extending from the outer end 24 thereof. The tab 22 may be utilized to lift the lid from its closed position if such is desired. Disposed below the rim 14 is a groove 26 which extends from the first end 28 of the score line 20 to the opposite end 30 thereof. The groove 26 is continuous and extends in its entirety below the level of the rim 14.

Figure 2:
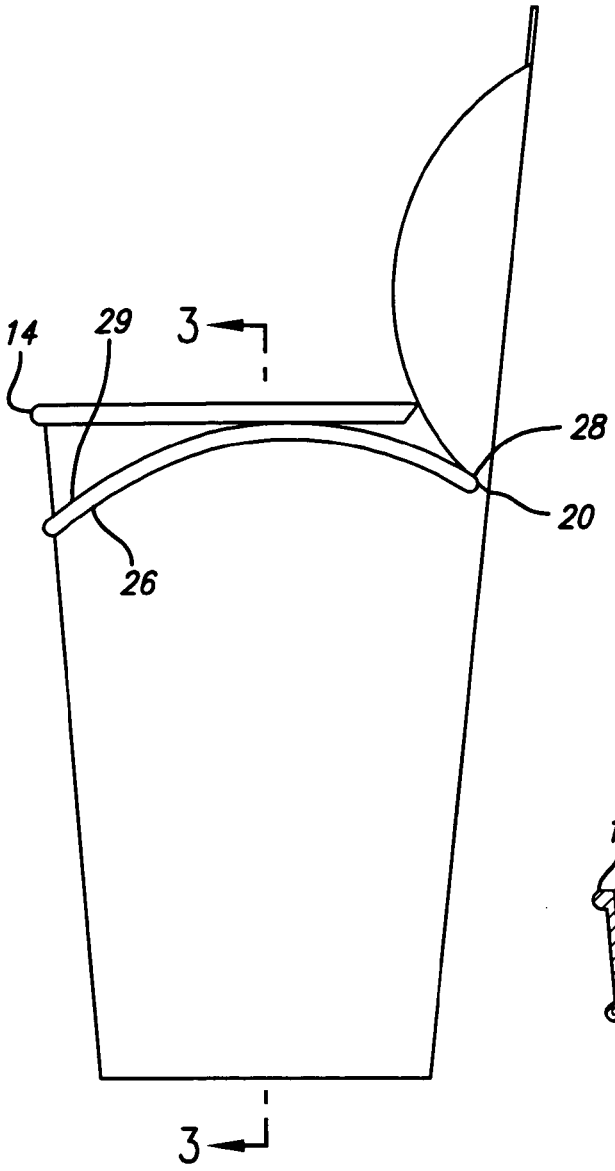
FIG. 2 is a left-side view of the container as illustrated in FIG. 1.
Figure 5:
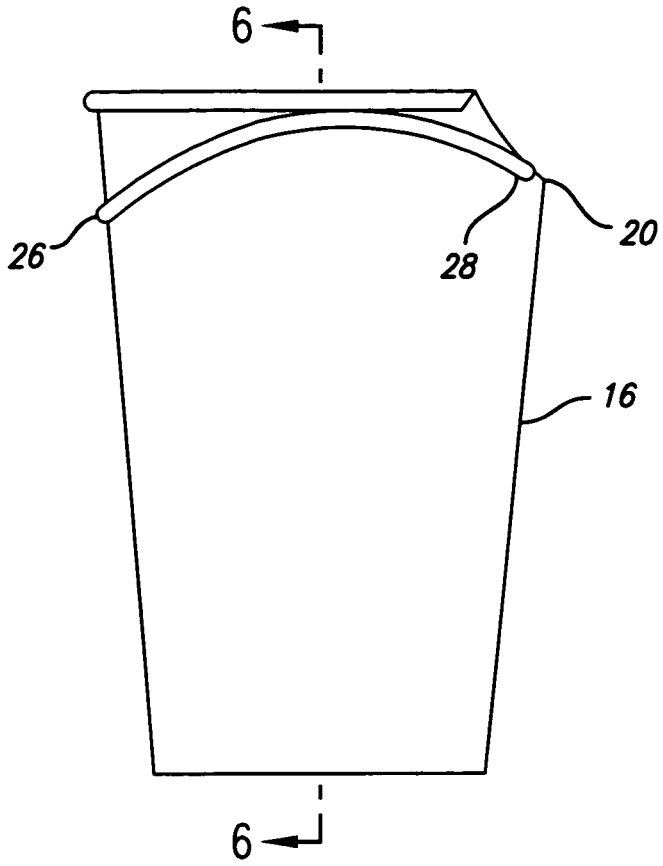
FIG. 5 is a perspective view of a container constructed in accordance with the principles of the present invention with the lid in the closed and sealed position.

Referring now more particularly to FIG. 2, the structure of FIG. 1 is illustrated in a left-side view. As is therein shown, the groove 26 is clearly disposed below the rim 14 and the groove commences at the left end portion 28 of the score line 20 which forms the hinge for the lid 18. As also illustrated, the groove 26 is disposed farther below the rim 14 on the wall 16 opposite the hinge 20 than it is at the hinge 20. Such structure provides a wall 29 (when the lid is closed) which will retain any fluid as shown in FIG. 5 that may remain adjacent the lid during consumption. As is illustrated in FIG. 2, the wall 16 of the container 10 may be flared slightly outward as is the case with most liquid containers although it will be recognized that such is not necessary in accordance with the principles of the present invention.

Figure 3:
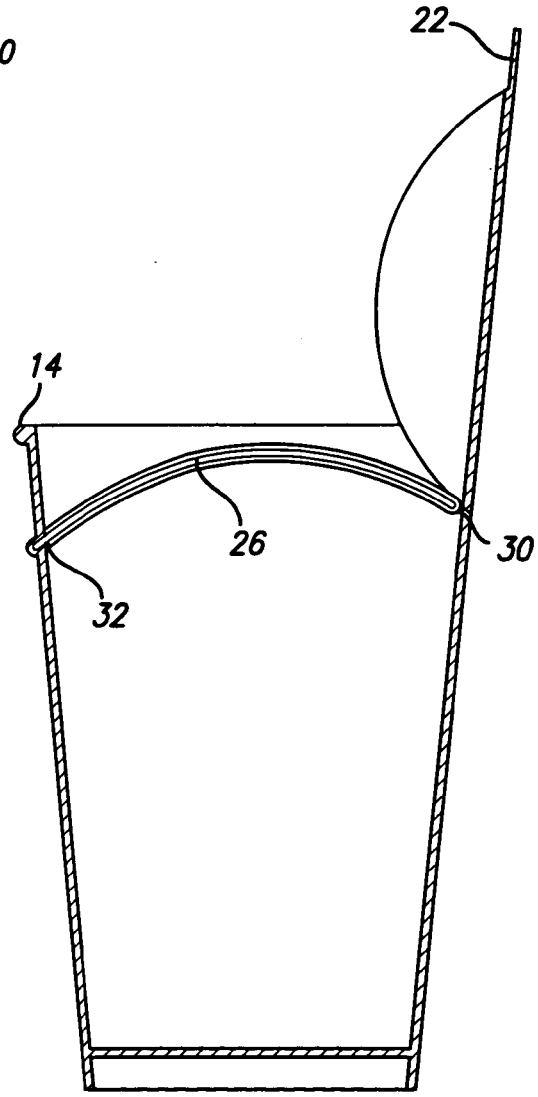
FIG. 3 is a cross-sectional, partial schematic showing the formation of a sealing groove in the wall of the container as shown in FIG. 2 and taken about the lines 3—3 of FIG. 2.

As is shown in FIG. 3 which illustrates the groove 26 in greater detail, the groove 26 is formed by continuously moving the wall 16 of the container outwardly to form a continuous inner surface 32 for the groove 26. As above described, the groove is continuous and runs from one end to the other of the score line 20, namely between the ends 28 and 30 thereof.

Figure 4:
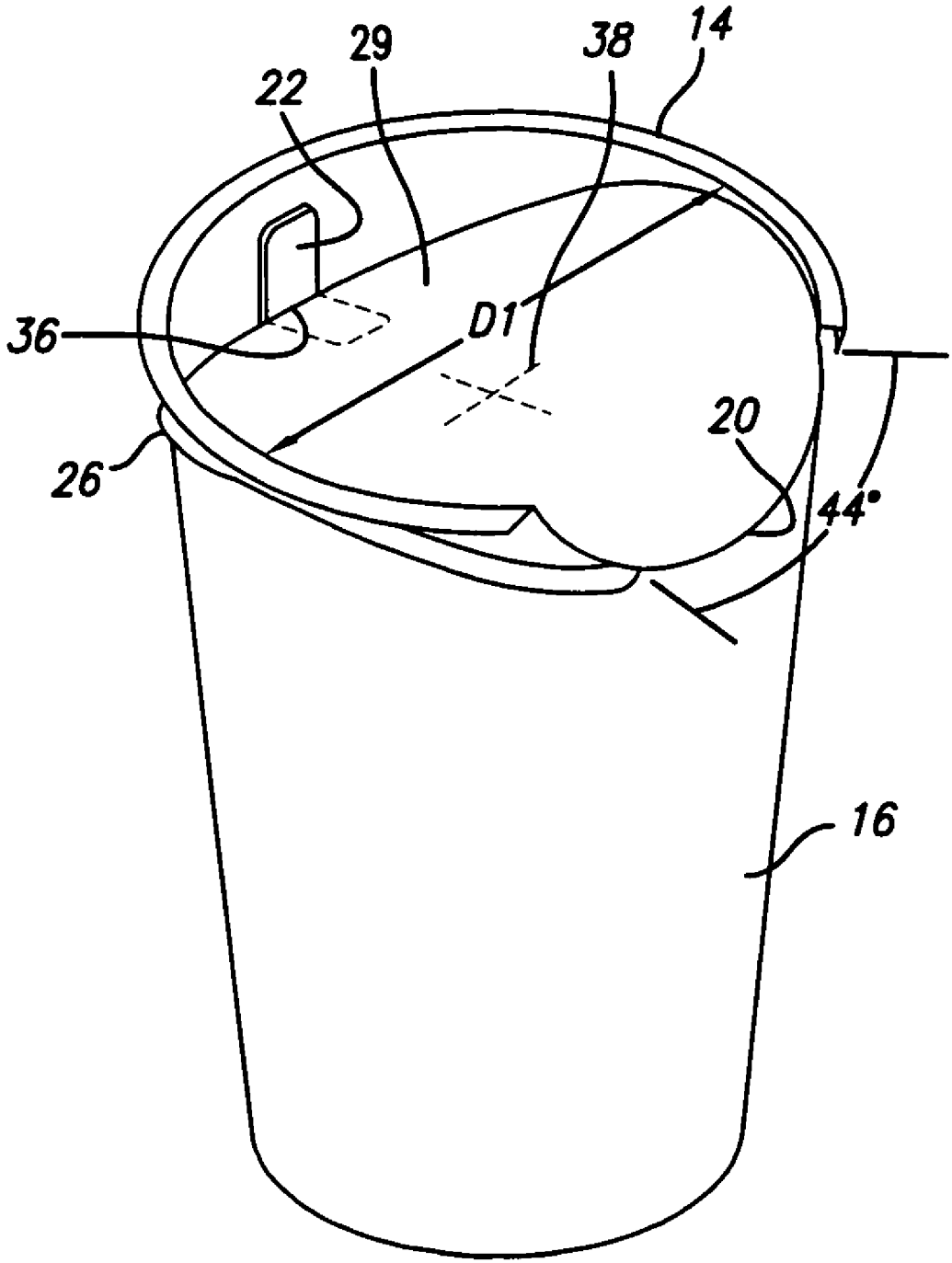
FIG. 4 is a rear view of the container as illustrated in FIG. 1.

Referring now more particularly to FIG. 4, which is a rear view of the container in accordance with the present invention as shown in FIG. 1. As is therein shown, the score line 20 which forms the hinge for the lid 18 is specifically indicated as preferably existing for a segment of 44 degrees. It should, however, be understood that although this is the preferred segment for the hinge, that the segment may extend from approximately 35 to approximately 60 degrees without departing from the spirit or scope of the present invention. As is also indicated in FIG. 4, the tab 22 may have a score line 34 to permit bending of the tab 22 when the lid is closed. There may also be provided perforations 36 about the point on the lid where the tab 22 joins the periphery of the lid 18 for the purpose of removing the tab and that portion of the lid to provide an aperture through which the contents of the container 10 may be dispensed as by sipping, pouring or the like. It should also be noted that additional perforations 38 may be provided in the lid 18 if desired so that a straw may be inserted through the lid into the contents of the container 10 for sipping the same.

It will be appreciated by those skilled in the art, particularly with reference to FIGS. 1, 2 and 4, that the lid 18 is essentially an extension of the side wall 16 forming the wall of the container and when in the open position maintains the same outwardly directed curvature as does the wall 16 of the container 10. It will also be noted that the rim 14 at the top of the container 10 has a first diameter D-1 as better seen in FIG. 5. The diameter of the lid 18 has a second diameter D-2, as illustrated in FIG. 4. The diameter D-2 is greater than the diameter D-1 for a purpose to be described more fully with respect to FIG. 5.

Figure 6:
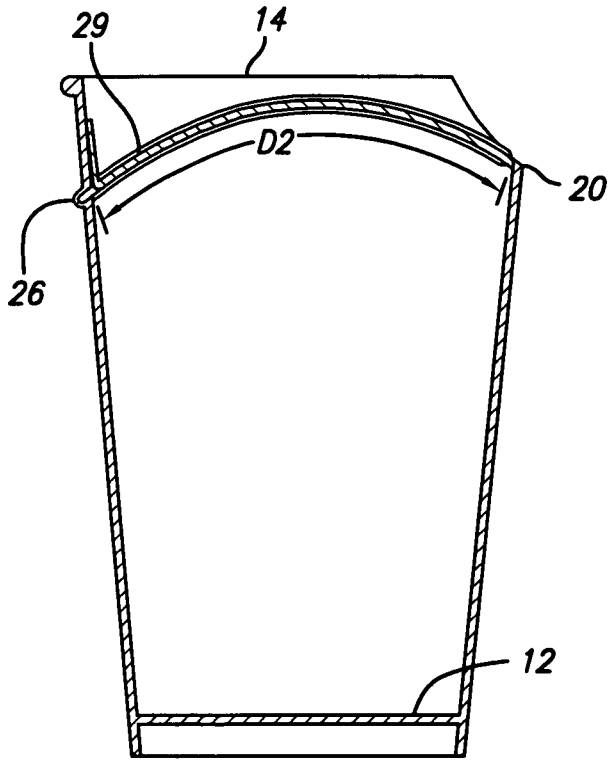
FIG. 6 is a partial schematic cross-sectional view taken about the lines 6—6 of FIG. 5 showing the lid in its sealed position.

Referring now more specifically to FIG. 5, there is illustrated in a perspective view the container in accordance with the principles of the present invention with the lid 18 in the closed position. As can be seen, the lid 18 has been hinged downwardly about the score line 20 and then pushed into a downward position so that the contour of the outer surface of the lid 18 now moves downwardly at the end 24 thereof and the periphery of the lid 18 engages the internal surface 32 of the groove 26 as shown more fully in FIG. 6. By the diameter of the lid 18 being greater than the diameter of the rim D-1, the lid when pushed downwardly will move into a position so that its periphery fully engages the groove 26 along its inner surface 32 between the ends 28 and 30 of the score line or hinge 20 so that an effective seal is accomplished for the contents of the container 10 to substantially eliminate leakage of the contents thereof.

There has thus been disclosed a container having an integral lid which is formed so that the periphery of the lid engages a groove formed continuously in the wall of the container between the ends of the hinge securing the lid to the wall of the container, such that the lid when placed in the closed condition engages the groove to seal the container.

What is claimed is:

1. A container having an integral lid comprising:

(a) a wall interconnecting a rim having a first diameter and a bottom;

(b) a lid having a peripheral edge and being hingedly connected to said wall at a position below said rim;

(c) said hinged connection being defined by a score line extending along said wall between 35° and 60°; and (d) a groove in said wall disposed entirely below said rim, said peripheral edge of said lid being captured in said groove when said lid is closed and positioned below said rim to seal said lid.

2. A container as defined in claim 1 wherein said lid has a second diameter, said second diameter being larger than said first diameter.

3. A container as defined in claim 1 wherein said groove is disposed further below said rim on said wall opposite the hinged connection of said lid to said wall than the hinged connection.

4. A container as defined in claim 1 wherein said groove commences and ends at opposite ends of said hinged connection.

5. A container as defined in claim 1 wherein said lid further includes a pull tab disposed opposite said hinged connection.

6. A container as defined in claim 5 wherein said lid has perforations adjacent said pull tab for permitting removal of a portion of said lid to define an opening for dispensing contents within said container.

7. A container as defined in claim 2, wherein said lid, when open, has a generally outward contour similar to that of said wall but, when closed, has an inward contour extending into the inner portion of said container.

8. A container as defined in claim 7 wherein the periphery of said lid is adapted to seat within the entirety of said groove.

* * * * *